US009781968B2

(12) United States Patent
Meraw et al.

(10) Patent No.: US 9,781,968 B2
(45) Date of Patent: Oct. 10, 2017

(54) APPARATUS FOR A SHOE

(71) Applicant: TECHNOSLIPS INC., Toronto (CA)

(72) Inventors: Michael J. Meraw, Bralorne (CA); Dean Dyckow, Brossard (CA); Eser Garipagaoglu, Fort Lauderdale, FL (US)

(73) Assignee: TECHNOSLIPS INC., Toronto (CA)

( * ) Notice: Subject to any disclaimer, the term of this patent is extended or adjusted under 35 U.S.C. 154(b) by 23 days.

(21) Appl. No.: 14/695,788

(22) Filed: Apr. 24, 2015

(65) Prior Publication Data

US 2015/0305433 A1 Oct. 29, 2015

Related U.S. Application Data

(60) Provisional application No. 62/144,430, filed on Apr. 8, 2015.

(51) Int. Cl.

| | |
|---|---|
| ***A43B 3/00*** | (2006.01) |
| ***A47L 23/04*** | (2006.01) |
| ***A43B 1/00*** | (2006.01) |

(52) U.S. Cl.

CPC ..... *A43B 3/0031* (2013.01); *A43B 1/0036* (2013.01); *A43B 1/0081* (2013.01); *A43B 3/001* (2013.01); *A47L 23/04* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,488,126 | A * | 1/1970 | Avallone | A47K 7/028 401/201 |
| 4,823,426 | A | 4/1989 | Bragga | |
| 5,421,106 | A | 6/1995 | Emrick | |
| 5,555,564 | A | 9/1996 | Welch | |
| 5,570,824 | A * | 11/1996 | Lyon | A45F 3/00 224/148.5 |
| 5,611,470 | A * | 3/1997 | Vias | A45C 1/04 224/240 |
| 6,128,801 | A | 10/2000 | Adzick et al. | |
| 6,659,669 | B1 * | 12/2003 | Nguyen | A47K 7/03 15/229.11 |
| 2014/0047652 | A1 | 2/2014 | McLaughlin | |

FOREIGN PATENT DOCUMENTS

| | | |
|---|---|---|
| CN | 202051016 U | 11/2011 |
| JP | 19990216643 | 2/2001 |
| WO | 2012148496 | 11/2012 |

* cited by examiner

*Primary Examiner* — David Walczak
(74) *Attorney, Agent, or Firm* — Gonzalo Lavin

(57) ABSTRACT

An apparatus removably attachable to a shoe with laces and a sole. The apparatus comprises a front side and back side, lower and upper opposite ends and opposite sides. The front side of the apparatus has a front pocket and the back side of the apparatus has a transversal strap extending between both opposite sides of the apparatus and a longitudinal strap extending from the lower opposite end of the apparatus. The longitudinal strap has an extendible loop configured to be removably latched onto a hook device located at the upper opposite end of the apparatus. When removably attaching the apparatus onto the shoe, the longitudinal strap is weaved through the laces of the shoe and the extendible loop is extended over the hook device so as to securely attach the apparatus onto the shoe.

11 Claims, 10 Drawing Sheets

Figure 1 – "PRIOR ART"

Figure 2 – "PRIOR ART"

Fig. 3 "PRIOR ART"

Figure 4 - "Prior Art"

Figure 5 - "PRIOR ART"

Figure 6 - "PRIOR ART"

APPARATUS FOR A SHOE

REFERENCES TO A RELATED APPLICATION

This application claims priority to U.S. Provisional Application Ser. No. 62/144,430, filed on Apr. 8, 2015, the entire content of which is incorporated herein by reference.

FIELD OF THE INVENTION

The present invention relates to an apparatus for a shoe. More specifically, the present invention relates to an apparatus that is designed to provide safety properties, as well as for the removal of foreign particles from the sole of a shoe.

BACKGROUND OF THE INVENTION

The interaction between footwear and a surface is of utmost important for individuals who are looking to maximize performance. As such, individuals often use footwear designed to provide a high level of traction between the sole of the shoe and a surface (i.e. a basketball court, a badminton court, etc.). However, as the sole of a shoe becomes dirty, its ability to stick onto a surface will diminish; thereby decreasing athletic performance and increasing the possibility of injury as a result of slippage on a given surface.

Traction with a surface may be restored to an athletes' footwear by cleaning the sole of the shoe by, for example: (i) wiping the sole of the shoe on sticky mats known as Stick'Ums™ or Slipp-Nott™, which are placed on the outside boundary of a playing surface; (ii) wiping a dry or moist cloth, such as a sock or rag, onto the sole of a persons shoe; (iii) applying a powder onto the sole of a shoe; and/or (iv) using a variety of cleaning pads or other devices that may attached over the tongue or shoelaces of a shoe.

U.S. Pat. No. 4,823,426 discloses a cleaning device for dislodging, picking up and retaining foreign particles, wherein the device is attached onto a shoe by making use of attachment means that clasps around the fastened footwear laces and are interlocked by means of Velcro™ type fastener strips. Such device is disclosed in FIG. 1, of the present application.

As it can be seen in FIG. 2, U.S. Pat. No. 5,421,106 discloses a removable shoestring cover for athletic shoes which provides an upwardly facing wiping surface of suede or other material, and which cover is attached to the shoestrings at the upper and lower edge of the cover by flaps which fold around portions of the shoestrings and are held by a hook and loop type fastener.

U.S. Pat. No. 5,555,564 discloses a shoe sole wiping pad sewn to the outer surface of an athletic sock. The wiping pad has a moisture-bearing wiping surface that removes dust and debris from the sole of an athletic shoe. The wiping pad cannot be removed from the sock for moisture replenishment.

U.S. Pat. No. 6,128,801 discloses a shoe sole cleaner that removes debris from a sole of a user's shoe by swiping the sole over the shoe sole cleaner on the user's opposing shoe. As it can be seen in FIG. 3, a two-part mechanical fastener (e.g., hook-and-loop) securing the shoe sole cleaner to a shoe by its shoelaces.

Japanese patent application no. JP19990216643 discloses a device comprising a base member located on the tip of shoe and cleaner member. As it can be seen in FIG. 4, the two members are detachably fastened to one another.

As it can be seen in FIG. 5, Chinese patent application no. CN20112111155U discloses a sports shoe with anti-slippage shoe tongues made with magic tape.

International laid-open publication no. WO2012/148496A1 (corresponding to U.S. Publication no. 2014/0047652) discloses a traction-enhancing cleaning kit, comprising a hook-and-loop attachment, that is mounted atop an anchoring platform. As it can be seen in FIG. 6, the kit must be laced onto an athlete's shoe; thereby requiring an individual to remove the laces from the shoe(s) and rethreading them through the device to attach it thereon.

An important drawback of the devices of the prior art is that when pressure is applied thereon by a user, i.e., when a user wipes the sole of his or shoe over the device, or when an athlete makes a sudden movement during play, the attaching means of these devices detach themselves from the shoe. For instance, when Velcro™ attachments are used, FIGS. 1 and 3, they may become loose during play or worse completely detach themselves from the corresponding member, as a result of the amount of pressure an athlete applies onto the opposite shoe so as to clean the sole of the opposite shoe, or as result of quick player movements. Moreover, when Velcro™ is used in shoe devices, it is subject to wear and tear and become simply ineffective when fibres and/or dirt particles accumulate therein; thereby completely losing its adhesive properties. Velcro™ also has an additional drawback of abrading shoelaces, as well as other fine materials such as silk, rayon, or fine cotton blends, which may be in users gym bag.

In other instances, the device of the prior art, FIG. 6, cannot be easily attached onto a shoe. In this particular case, an individual must remove the laces of a shoe, mount the device on the tongue of a shoe and begin threading the laces through the stirrups of the device and the corresponding eyelets of a shoe. Not only is this a time consuming process, but, as a result of the construction or design of the device, the stirrups of the device are susceptible of breaking or being damaged, as a result of: (i) normal wear and tear of the device, and (ii) the over tightening of shoelaces by an individual; thereby exerting too much pressure on the stirrups, which in turn causes them to break. In the same vein, the stirrups of the device may be damaged as a result of the athlete's brusque rubbing of his or her shoe on the opposite shoe.

There is therefore a need for a safe, compact, portable and universal apparatus that can be easily attached onto and detached from a shoe and that can perform a multitude of functions, such as, for example: (i) providing anti-slip properties to a sole of shoe; thereby enhancing an individual's traction on a surface (i.e., a playing or performing surface); (ii) provide one or more pocket(s), in which an individual can store assets (i.e., valuables); as well as (iii) providing reflective and/or emitting lighting properties in low-light conditions.

SUMMARY OF THE INVENTION

The present invention overcomes all of the above drawbacks by providing an apparatus capable of, for example: firstly, preventing one from slipping when playing sports on a dusty or dirty surface; secondly, allowing one to secure one's small personal effects on to their person when playing sports, or pursuing recreational activities, which is safer than using a locker for example; and/or thirdly, optimizing one being seen in low-light conditions, i.e. at night when walking, jogging, or cycling outside.

In accordance with one aspect of the invention is to provide an apparatus removably attachable to a shoe with laces and a sole, wherein the apparatus comprises:

a front side and back side, lower and upper opposite ends and opposite sides;

the front side of the apparatus comprising a front pocket;

the back side of the apparatus comprising a transversal strap extending between both opposite sides of the apparatus and a longitudinal strap extending from the lower opposite end of the apparatus, said longitudinal strap comprising an extendible loop configured to be removably latched onto a hook device located at the upper opposite end of the apparatus;

wherein when removably attaching the apparatus onto the shoe, the longitudinal strap is weaved through the laces of the shoe and the extendible loop is extended over the hook device so as to securely attach the apparatus onto the shoe.

According to another aspect of the invention, the apparatus further comprises a luminescent material for reflecting and/or emitting light.

According to another aspect of the invention, the apparatus further comprises a flap for closing the pocket.

According to another aspect of the invention, the apparatus further comprises a pocket for receiving assets therein.

According to yet another aspect of the invention the apparatus further comprises a light emitting diode adapted to be inserted into the front pocket.

Generally, the object of the invention is to provide an apparatus which can be readily and removably attached to the outer portion of an athlete's shoe (i.e., above the tongue of the shoe) to enable the quick removal of foreign particles from the soles of the shoe by simply brushing the soles of the shoe worn on each foot back and forth across the cleaning device on the shoe worn on the other foot, whilst releasing an amount of liquid solution. The combination of materials used for the apparatus according to the present invention have been selected to avoid loss of liquid solution during use of thereof.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

While the above identified drawings set forth several preferred embodiments, other embodiments of the present invention are also contemplated, as noted in the detailed description. This disclosure presents illustrative embodiments of the present invention by way of representation and not limitations. Numerous other modifications and embodiments can be devised by those skilled in the art which fall within the scope and spirit of the principles of this invention.

DETAILED DESCRIPTION OF THE INVENTION

Reference will now be made in detail to preferred embodiments of the present invention, examples of which are illustrated in the accompanying drawings. Wherever possible, the same reference numbers will be used throughout the drawings to refer to the same or like parts.

Figure 11:
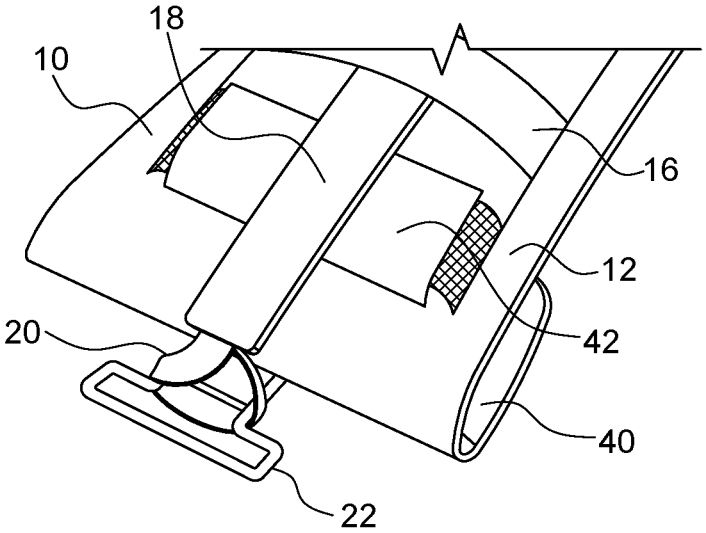
FIG. 11 is a perspective view of back side of the apparatus shown in FIG. 7.
Figure 12:
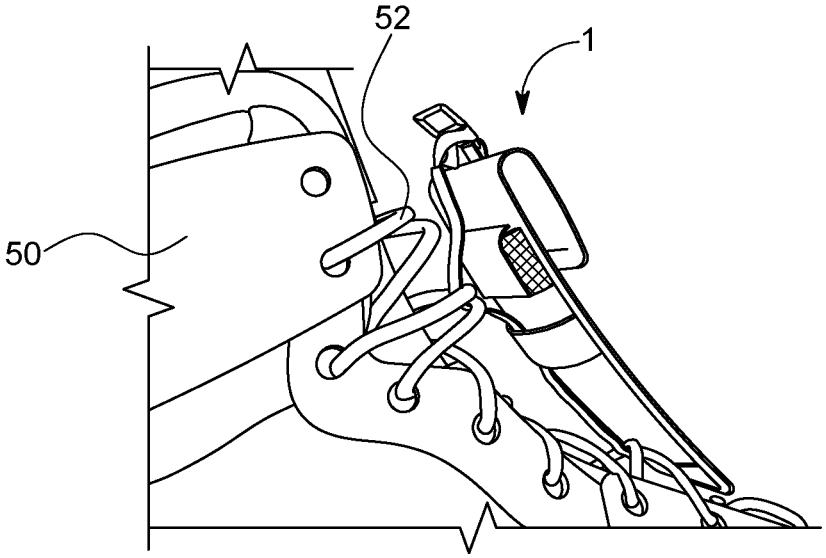
FIG. 12 is a perspective view of the apparatus shown in FIG. 7, attached to the shoe laces of a shoe.
Figure 13:
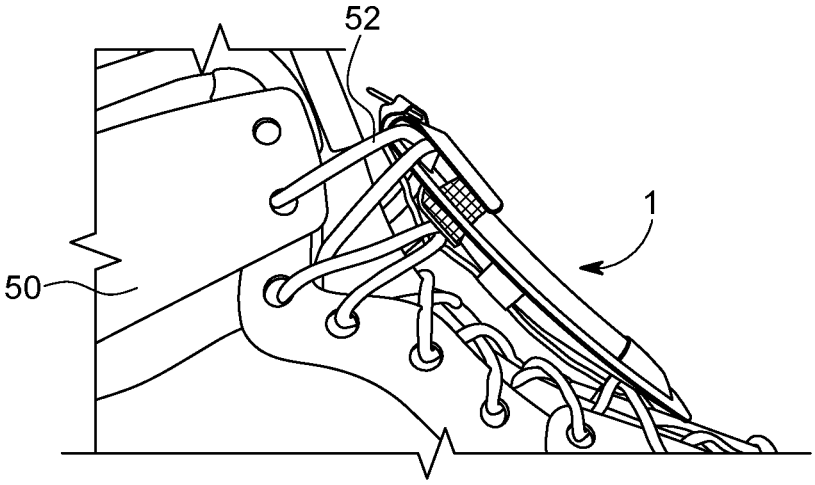
FIG. 13 is a perspective view of the apparatus shown in FIG. 7, attached to the shoe laces of a shoe.
Figure 14:
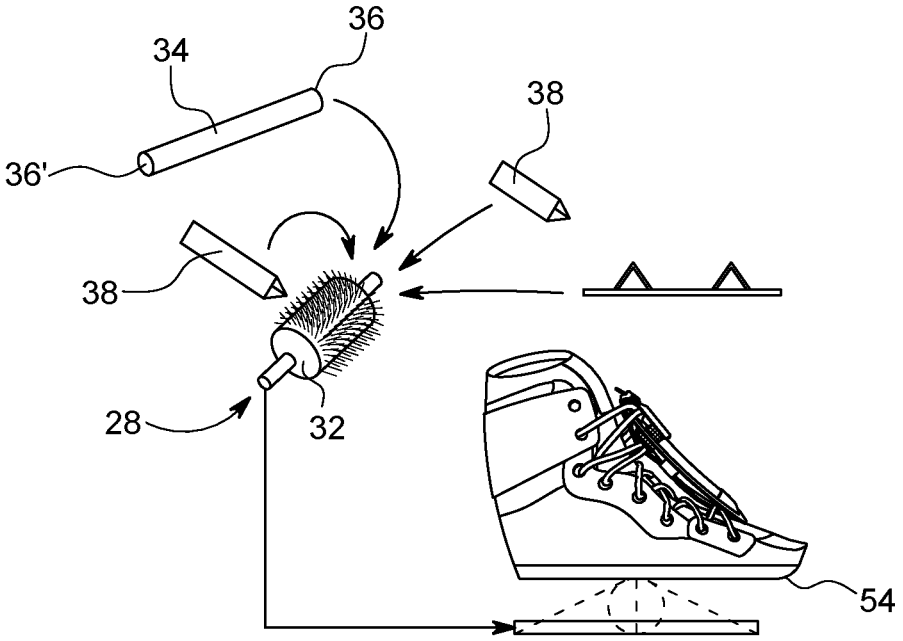
FIG. 14 is a perspective view of a permeable bladder according to a preferred embodiment of the present invention.

As it can be seen in FIGS. 12, 13 and 14, the present invention is an apparatus 1 removably attachable to a shoe 50 with laces 52 and a sole 54. As it appears in FIGS. 7, 9 and 10 to 13, the apparatus 1 comprises a front side 2 and back side 4, lower and upper opposite ends 6, 8 and opposite sides 10, 12. The front side 2 of the apparatus 1 comprises of a front pocket 14.

Figure 1:
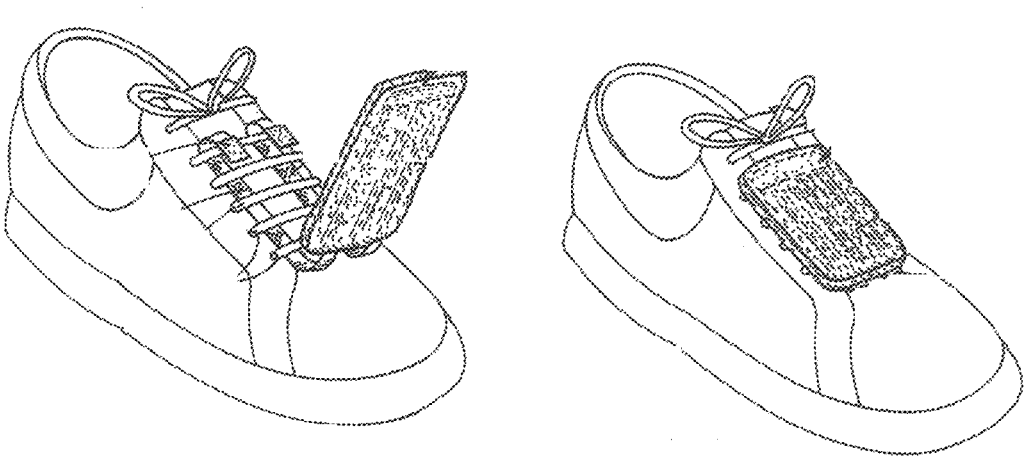
FIG. 1 is a perspective view of a cleaning device of the prior art, in open and closed positions, for dislodging, picking up and retaining foreign particles of shoe, as disclosed in U.S. Pat. No. 4,823,426.
Figure 2:
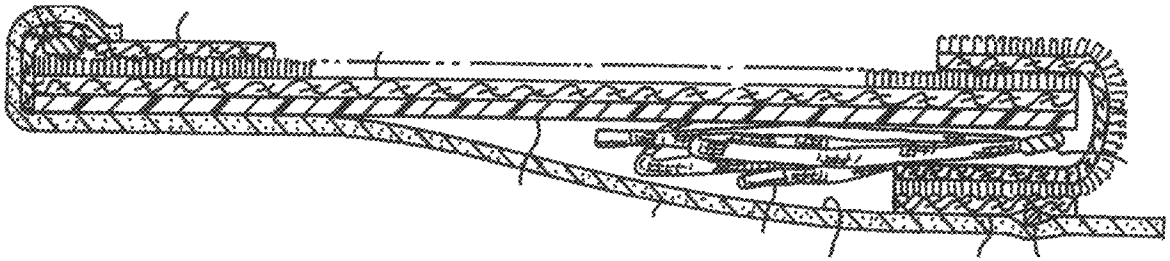
FIG. 2 is a cross-section view of a removable shoestring cover according to the prior art, as disclosed in U.S. Pat. No. 5,421,106.
Figure 3:
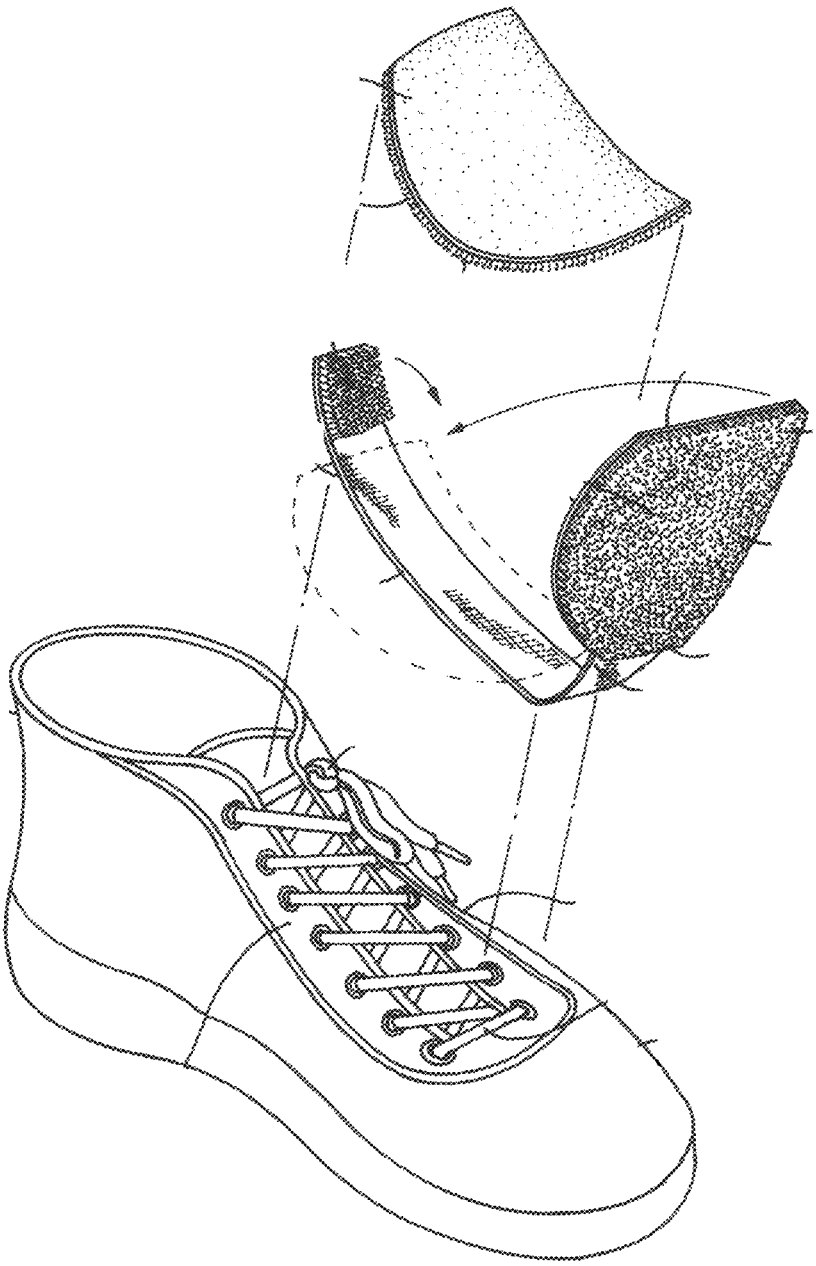
FIG. 3 is a perspective and exploded view of a shoe sole cleaner of the prior art, as disclosed in U.S. Pat. No. 6,128,801.
Figure 4:
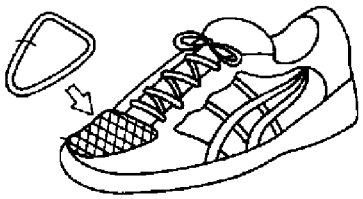
FIG. 4 is a perspective and exploded view of a device of the prior art for cleaning the sole of a shoe, as disclosed in Japanese patent application no. JP19990216643.
Figure 5:
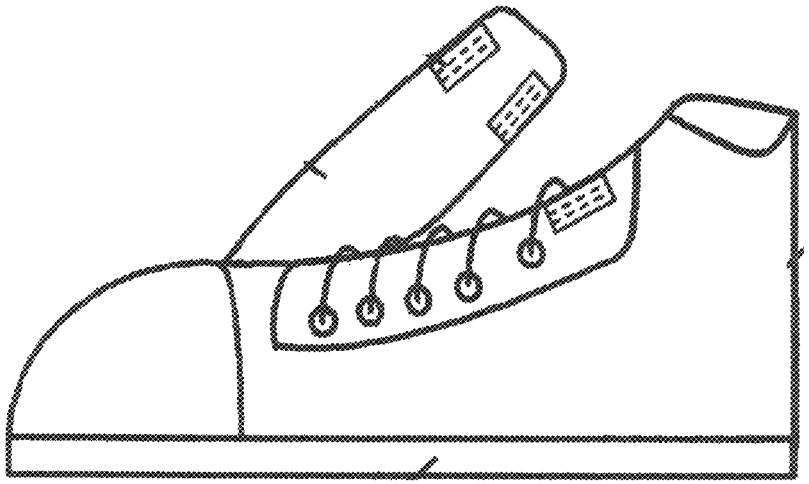
FIG. 5 is a side view of an anti-slippage device of the prior art, as disclosed in Chinese patent application no. CN20112111155U.
Figure 6:
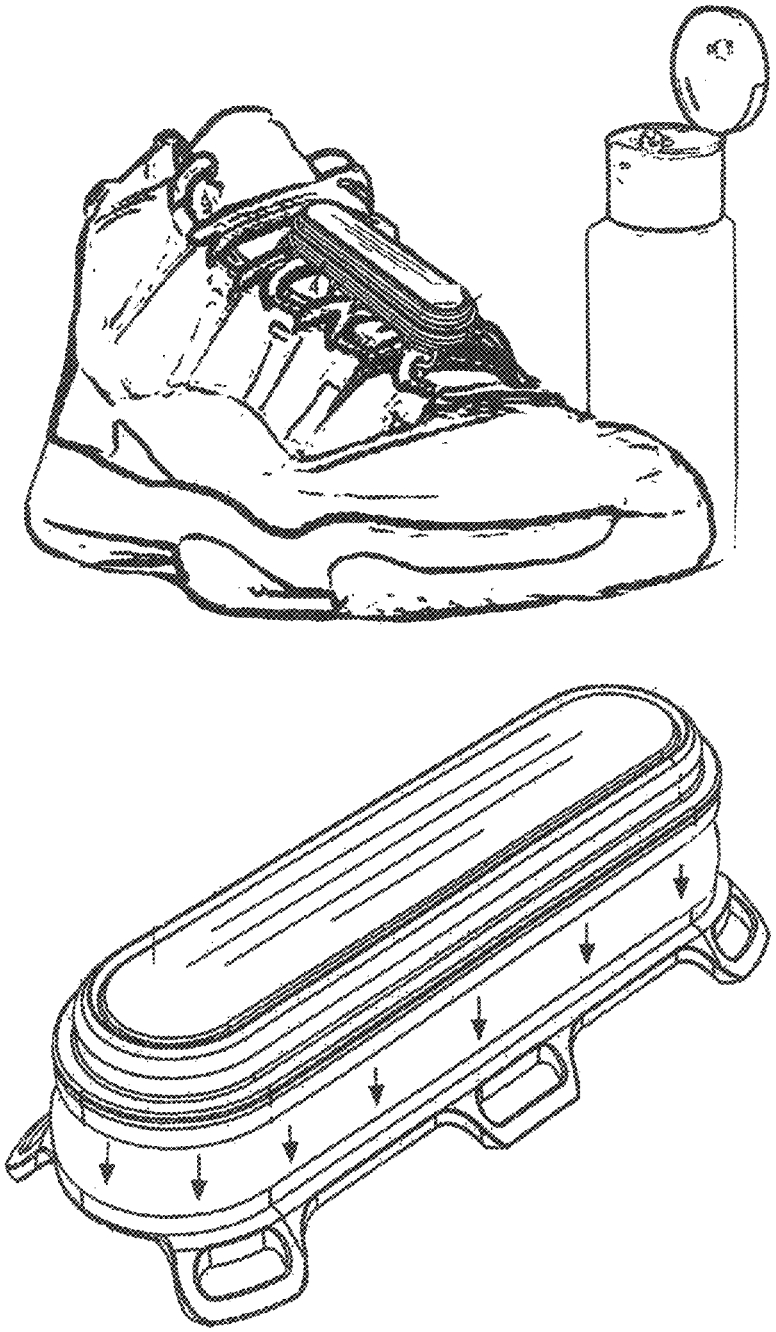
FIG. 6 is a perspective view of a traction-enhancing cleaning kit of the prior art, as disclosed in U.S. Publication no. 2014/0047652.
Figure 7:
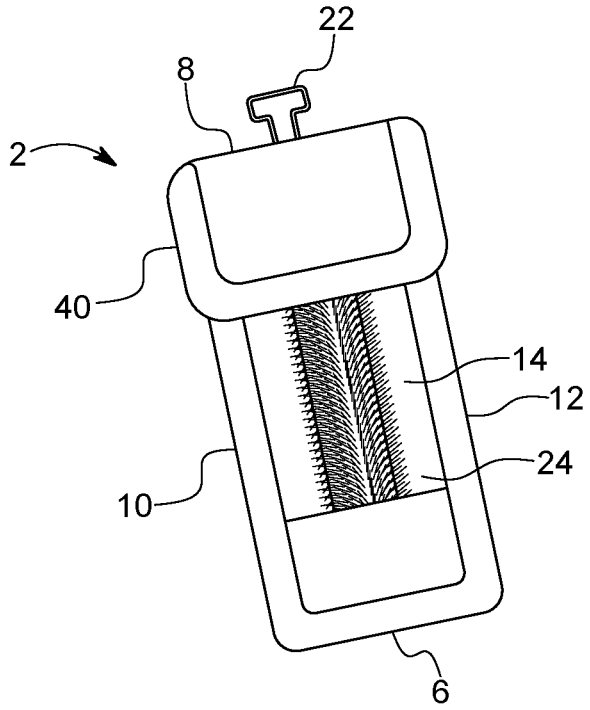
FIG. 7 is a front view of an apparatus according to a preferred embodiment of the present invention.

FIGS. 7 and 13 are perspective views of the front side 2 of the apparatus 1. As it can be seen therein, the front pocket 14 may comprise of a front porous side 24 or a luminescent material for reflecting and/or emitting light. In a preferred embodiment, the front porous side 24 is made of up a material, such as mesh, that allows for the release (or passing through), preferably a metered release, of a liquid solution contained within the liquid releasing device 26 onto the sole 54 of a shoe 50 when pressure is applied thereon by an individual other shoe. Different types of porous materials can be considered, for example: mesh, frames or matrices manufactured out of polymers, plastic, metals or combinations thereof, as well as other types of porous materials known to a person skilled in the art. Preferably, a factor to consider when selecting the porous material is that the pores of the material cannot be so large that the liquid solution freely flows from, or drips out of the liquid releasing device 26 onto the individual's shoe, especially when pressure is applied onto the front pocket 14 by the individual's other shoe. Additionally, the use of a front porous side 24 allows for the collection of dirt or dust particles. Indeed, when pressure is applied onto the front pocket 14 with the individual's other shoe a sufficient amount of liquid is released from the liquid releasing device 26 so as to enable the sole 54 of the other shoe 50 to regain its anti-slip properties and be cleansed. In other words, when the liquid releasing device 26 is inside the front pocket 14 and upon pressure being applied thereto by another shoe, a liquid solution inside the liquid releasing device 26 is released through the front porous side 24 so as to clean the sole of the other shoe.

In a preferred embodiment, the opposite sides 10, 12 and the opposite ends 6, 8 can be equipped with brush-like, bristled edges, so as to remove dust or dirt from the bottom of a shoe. Alternatively, the opposite sides 10, 12 and opposite ends 6, 8 can be equipped with squeegee type materials, which could be used to absorb excess liquid from the sole 54 of the shoe 50.

Figure 8:
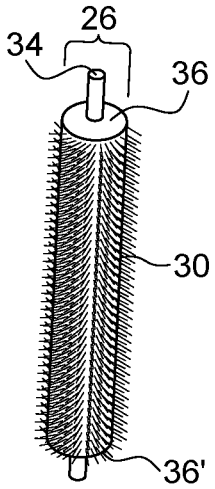
FIG. 8 is a perspective view of a liquid releasing device according to a preferred embodiment of the present invention.

As it can be seen in FIGS. 7 and 8, the front pocket 14 is further adapted to receive a liquid releasing device 26, which can be easily washed, dried, reused, recycled and/or replaced. FIG. 8 is a perspective view of the liquid releasing device 26. In a preferred embodiment, the liquid releasing device 26 comprises a permeable bladder 28 (shown in FIG. 14) capable of retaining a liquid solution and an external surface made up of filaments 30. The permeable bladder 28 can be reusable or not. In a preferred embodiment the permeable bladder is made up of sponge like filaments 30 and can possibly contain an inlet for receiving a liquid solution. In a preferred embodiment, the liquid releasing device 26 can be doused, or soaked, with a variety of liquids, which are retained therein. As for choice of liquid solution to be used in the liquid releasing device 26, different liquid solutions can be considered by a person skilled in the art. For example, one could make use of water, soap and/or tackifier solutions, gels, antimicrobial solutions, either alone or in combination thereof; in as long as the liquid solution does not damage the playing surface or the soles of a shoe.

In a preferred embodiment, and as it appears in FIG. 14, the permeable bladder 28 comprises a sponge like material, i.e., sponge 32, and a support rod 34 that extends from one end 36 of the permeable bladder 28 to the other 36'. The support rod 34 can be used to provide the permeable bladder 28 a structure. The support rod 34 can be made out of plastic or any other material as contemplated by a person skilled in the art. In a preferred embodiment, the support rod 34 is designed in such a way to have at least one enlarged portion so as to reduce compression of the sponge 32 when pressure is applied thereon by the individual's shoe and to avoid leakage. The at least one enlarged portion 38 can be in the form of one or more bump(s) or elongated arm(s); the latter of which is perpendicular to the support rod 34. Of course, other designs may be contemplated by a person skilled in the art, in as long as an individual cannot completely compress (or exert too much pressure on) the liquid releasing device 26 so that the liquid solution contained therein gushes out. The use of at least one enlarged portion 38, in conjunction with a sponge 32, preferably allows for improved surface contact between the liquid releasing device 26 and the front porous side 24. This design allows the sponge 32 and filaments 30 to be raised towards the front porous side 24 and have a greater surface contact with the sole 54 of the shoe 50 being rubbed over the apparatus 1. Such preferably enables an individual to clean a greater surface area of the sole 54 of the other shoe 50 with the apparatus 1 according to the present invention, and restoring the shoe(s) 50 properties, such as adhesion, tackiness and the like to a playing surface; thereby avoiding slippage and player injury.

As opposed to inserting a liquid releasing device 26 in the front pocket 14, it is possible to insert a light emitting diode ("LED") therein. By doing so, individuals can be seen at dawn, dusk, or night, and in all weather conditions. Preferably, an individual could insert a flexible LED light strip or glow stick the front pocket 14 of the apparatus 1. As a result of the properties of the front pocket, namely the front porous side 24 and the use of a porous material (i.e., mesh), it the light emitted from the LED radiates and reflects on the mesh therefore providing more surface radiance.

As opposed to having a front porous side 24, the front pocket 14 can be made of a luminescent material for reflecting and/or emitting light. In cases where a light source, for example a headlight or streetlight, shines onto the luminescent material, the front pocket 14 will reflect and/or emit such light; thereby, allowing a driver of a vehicle or a passer-by to see where the individual is exercising. This embodiment is particularly advantageous when an individual is exercising at dusk or at night, and needs to be visible to others for safety concerns. In a preferred embodiment, luminescent materials include but are not limited to materials such 3M Scotchlite™ and other reflective materials known to a person skilled in the art.

Figure 9:
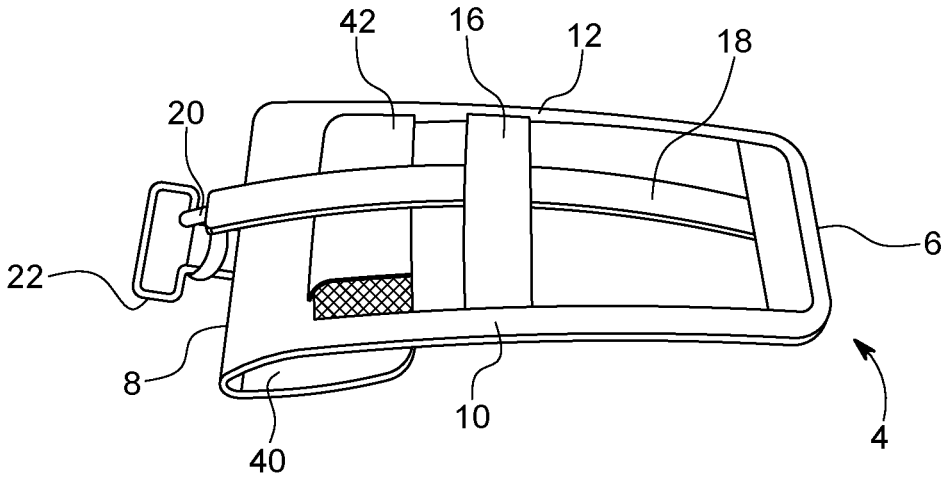
FIG. 9 is a perspective view of the back side of the apparatus shown in FIG. 7.
Figure 10:
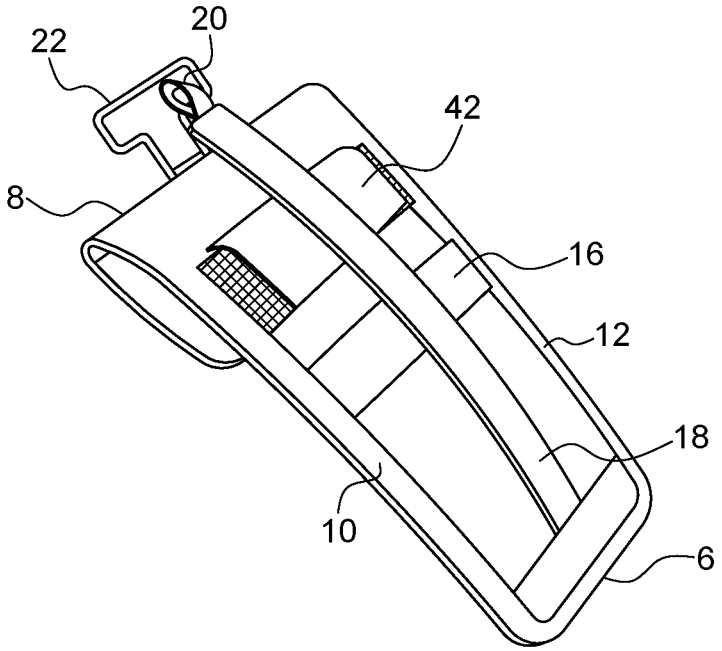
FIG. 10 is another perspective of the back side of the apparatus shown in FIG. 7.

As it appears in FIGS. 9 to 11, the back side 4 of the apparatus 1 comprises a transversal strap 16 extending between both opposite sides 10, 12 of the apparatus 1 and a longitudinal strap 18 extending from the lower opposite end 18 of the apparatus 1. The longitudinal strap 18 comprises an extendible loop 20, which is configured to be removably latched onto a hook device 22 located at the upper opposite end 8 of the apparatus 1. In a preferred embodiment, the hook device 22 may be a T-shaped handle, whereupon the extendible loop 20 can be looped thereover. Of course, other means for fastening the extendible loop 20 over the hook device 22 can be considered; for example: Velcro™ attachments, snap buttons, hitching posts and the like.

In order to attach the apparatus 1 onto the shoe 50, the longitudinal strap 18 is weaved through the laces 52 of the shoe 50 and the extendible loop 20 is extended over the hook device 22 so as to securely attach the apparatus onto the shoe. As it appears in FIGS. 12 and 13, the longitudinal strap 18 is also adapted to be woven under the transversal strap 16 of the apparatus 1 so as to provide a further point of contact between the shoe and the apparatus for reducing movement of the apparatus thereon. Preferably, the longitudinal strap 18 is made out of semi-flexible fabric so that the apparatus 1 is in closer contact with the laces 52 of a shoe 50. In order to attach the apparatus 1 onto the shoe 50, an individual places the apparatus 1 over the shoe 50, and then: (a) weaves the longitudinal strap 18 under the laces, (b) over the transversal strap 16 (i.e., closest to back side 4 of the apparatus 1), (c) under the shoelaces 52, and then (d) extends the extendible loop 20 over the hooking device 22. Once such has been completed, the apparatus 1 is securely attached onto the shoe 50. The same can be done for the individual's alternate shoe 50. An advantage of using such an apparatus 1 is that: (1) liquid solution can easily be added onto the liquid releasing device 26, which can absorb the liquid as a result of the sponge 32, and (2) it can easily be removed from the shoe 50 and cleaned, without undoing the laces 52 of the shoe 50, as disclosed in the prior art.

To remove the apparatus 1, one only need to lift (or unhook) the extendible loop 20 from the hook device 22. Once the extendible loop 20 has been freed from of the hook device 22, the individual can simply pull the apparatus 1 from the shoe 50 and the longitudinal strap 18 will naturally unthread itself from the shoelaces, as the apparatus is being pulled off the shoe 50.

According to the present invention, the back side 4 of the apparatus 1 can also be equipped with a back pocket 42 for receiving assets, such as keys, cards, jewelry, money and other small valuables, therein. The front pocket 14 can serve the same function when no liquid releasing device 26 or light emitting diode is inserted therein. As for the front pocket 14, the back pocket 42 is preferably stitched or integrated onto the apparatus 1. The addition of a back pocket 42 to the apparatus 1 allows an individual to be free of additional apparel, such as bracelets or necklaces on which they would normally attach their locker keys or other valuables, during exercise or play.

As it can be seen in FIGS. 7, and 9 to 13, the apparatus 1 according to the present invention, further comprising a flap 40 for closing the pocket. Indeed, a flap 40 can be positioned on both the front side 2 and/or the back side 4 of the apparatus. When the flap 40 is located on the front side 2, it can be used to cover the laces 52 of a shoe 50, as well as a portion of the front pocket 14 so as to ensure that the assets, the LED or the liquid releasing device 26 contained therein are secured and protected from the elements (i.e., rain water). In a preferred embodiment, the flap 40 is preferably made of a water-resistant material. The flap 40 can be securely attached onto the apparatus by making use of Velcro™, a snap or other fastening means known to a person skilled in the art; thereby making it easy to open and close the flap. By adding a flap 40 to the apparatus 1, it allows for a watertight seal between the outside elements and the contents of the front and back pockets 14, 42. By way of the aforementioned design, the assets contained with the front and back pockets 14, 42 do not get wet.

In addition to the above, the kit according to the present invention can be equipped with a strap. The strap can preferably be located across the middle back of the kit. Indeed, the strap could be threaded through the shoelaces and once the shoe laces have been pulled and tied by an athlete, it would prevent the kit according to the present invention from flopping up and down when worn.

In another embodiment, the apparatus according to the present invention could further comprise such a shoelace locking mechanism, which prevents one's shoelaces from becoming undone.

In use, it is preferred to install the apparatus 1 on both shoes. When an individual has completed his or her exercise or play, the individual can easily remove the apparatus 1 from his or her shoes, and insert them into a carrying case.

Furthermore, and by way of the design of the apparatus according to the present invention, the apparatus is easily removably attachable to a shoe. Indeed, the apparatus should be easy to put on and remove. Many athletes use their outdoor shoes as indoor shoes and will not want to have to unlace their shoes to lace in an anti-slip device, or do the reverse to remove it.

It should now be apparent that the above-described invention provides an effective apparatus for: (i) cleaning the soles of athletes' shoes, (ii) storing assets therein, as well as for (iii) safety issues (i.e., luminescence or reflective materials).

Although the present invention has been described with reference to preferred embodiments, the scope of the claims should not be limited by the preferred embodiments set forth in the examples, but should be given the broadest interpretation consistent with the description as a whole. Multiple embodiments of the inventive shoe sole cleaner are disclosed herein, and the features of different embodiments may be combined, as desired, to achieve an effective shoe sole cleaner design.

The invention claimed is:

1. An apparatus in combination with a shoe with laces and a sole, the apparatus being removably attachable to the shoe, wherein the apparatus comprises:

a front side and back side, lower and upper opposite ends and opposite sides;

a hook device located at the upper opposite end of the apparatus;

the front side of the apparatus comprising a front pocket;

the back side of the apparatus comprising a transversal strap extending between both opposite sides of the apparatus and a longitudinal strap extending from the lower opposite end of the apparatus, said longitudinal strap comprising an extendible loop configured to be removably latched onto the hook device located at the upper opposite end of the apparatus;

wherein when removably attaching the apparatus onto the shoe, the longitudinal strap is weaved through the laces of the shoe and the extendible loop is extended over the hook device so as to securely attach the apparatus onto the shoe;

wherein the front pocket comprises a front porous side and wherein the front pocket receives a liquid releasing device containing a liquid solution inside the liquid releasing device; and wherein when applying pressure by another shoe to the front pocket receiving the liquid releasing device, the liquid solution inside the liquid releasing device is released through the front porous side so as to clean the sole of the other shoe.

2. The apparatus according to claim 1, wherein the longitudinal strap is woven under the transversal strap of the apparatus so as to provide a further point of contact between the shoe and the apparatus for reducing movement of the apparatus thereon.

3. The apparatus according to claim 1, wherein hook device is a T-shaped handle, whereupon the extendible loop can be looped thereover.

4. The apparatus according to claim 1, wherein the liquid releasing device comprises a permeable bladder for retaining the liquid solution and an external surface comprising filaments.

5. The apparatus according to claim 4, wherein the permeable bladder comprises a sponge and a support rod that extends from one end of the permeable bladder to the other.

6. The apparatus according to claim 5, wherein the support rod has at least one enlarged portion so as to reduce compression of the sponge.

7. The device according to claim 1, wherein the front porous side comprises a mesh.

8. The apparatus according to claim 1, wherein the front pocket comprises a luminescent material for reflecting and/or emitting light.

9. The apparatus according to claim 1, further comprising a flap for closing the pocket.

10. The apparatus according to claim 1, wherein the back side comprises a back pocket for receiving assets therein.

11. The apparatus according to claim 1, further comprising a light emitting diode inserted into the front pocket.

* * * * *